US007811424B1

(12) United States Patent
Woods et al.

(10) Patent No.: US 7,811,424 B1
(45) Date of Patent: Oct. 12, 2010

(54) REDUCING MECHANICAL RESONANCE AND IMPROVED DISTRIBUTION OF FLUIDS IN SMALL VOLUME PROCESSING OF SEMICONDUCTOR MATERIALS

(75) Inventors: Carl Woods, Aptos, CA (US); Jeffrey J. Farber, Delmar, NY (US)

(73) Assignee: Lam Research Corporation, Fremont, CA (US)

( * ) Notice: Subject to any disclaimer, the term of this patent is extended or adjusted under 35 U.S.C. 154(b) by 696 days.

(21) Appl. No.: 11/205,532

(22) Filed: Aug. 16, 2005

Related U.S. Application Data

(63) Continuation-in-part of application No. 10/882,712, filed on Jun. 30, 2004.

(51) Int. Cl.
*C25D 21/00* (2006.01)

(52) U.S. Cl. ..... 204/242; 204/224 R

(58) Field of Classification Search ..... 204/242, 204/224 R

See application file for complete search history.

(56) References Cited

U.S. PATENT DOCUMENTS

| | | | | |
|---|---|---|---|---|
| 6,488,040 | B1 * | 12/2002 | de Larios et al. | 134/95.2 |
| 6,495,005 | B1 * | 12/2002 | Colgan et al. | 204/224 R |
| 6,854,473 | B2 * | 2/2005 | Hanson et al. | 134/95.3 |
| 2003/0146089 | A1 * | 8/2003 | Basol | 204/224 R |
| 2004/0178060 | A1 * | 9/2004 | Ravkin et al. | 204/232 |

* cited by examiner

*Primary Examiner*—Harry Wilkins
*Assistant Examiner*—Zulmariam Mendez
(74) *Attorney, Agent, or Firm*—Martine Penilla & Gencarella, LLP

(57) ABSTRACT

An apparatus for processing a substrate is provided. The apparatus includes a plating head configured to plate a surface of the substrate with a layer of a material using a fluid meniscus between the plating head and a surface of the substrate. The apparatus also includes a fluid meniscus stabilizing apparatus configured to apply a pre-processing fluid to the surface of the substrate before the fluid meniscus is applied to the surface.

20 Claims, 16 Drawing Sheets

REDUCING MECHANICAL RESONANCE AND IMPROVED DISTRIBUTION OF FLUIDS IN SMALL VOLUME PROCESSING OF SEMICONDUCTOR MATERIALS

CROSS REFERENCE TO RELATED APPLICATION

This application is a continuation-in-part of U.S. patent application Ser. No. 10/882,712 filed on Jun. 30, 2004 and entitled, "Apparatus And Method For Plating Semiconductor Wafers." This application is hereby incorporated by reference in its entirety.

BACKGROUND

In the semiconductor fabrication arts, electroplating is typically performed in a single-wafer processor, with the wafer immersed in an electrolyte. During electroplating, the wafer is typically held in a wafer holder, at a negative, or ground potential, with respect to a positively charged plate (also immersed in the electrolyte) which acts as an anode. To form a copper layer, for example, the electrolyte is typically between about 0.3M and about 0.85M $CuSO_4$, pH between about 0 and about 2 (adjusted by $H_2SO_4$), with trace levels (in ppm concentrations) of proprietary organic additives as well as Cl to enhance the deposit quality. During the plating process, the wafer is typically rotated to facilitate uniform plating. After a sufficient film thickness has been achieved during the plating process, the wafer is moved from the plating chamber to another chamber where it is rinsed in de-ionized (DI) water, to remove residual electrolyte from the wafer surface. Next the wafer is subjected to additional wet processing, to remove unwanted copper from the backside and bevel edge, and then another DI water rinse removes wet processing chemical residues. Then the wafer is dried and annealed before it is ready for the chemical mechanical planarization (CMP) operation.

During the plating process, the wafer acts as a cathode, which requires that the power supply be electrically connected to the wafer. Typically, numerous discrete contacts on the wafer holder connect the wafer holder electrically to the edge of the wafer. The current utilized to electroplate the wafers is provided through these contacts. Plating current is desired to be evenly distributed around the perimeter of the wafer to provide uniform deposition. Unfortunately, plating current is generally stronger in locations closer to the contacts. Therefore, uneven plating often occurs. In addition, when wafer is plated in a plating chamber, the time to plate the wafer can be lengthy.

What is needed is an electroplating system that produces uniform electroplating on wafers in an efficient and cost effective manner.

SUMMARY OF THE INVENTION

Broadly speaking, the present invention fills these needs by providing an apparatus that is capable of processing wafer surfaces that can stabilize a meniscus configured for wafer processing operations thereby significantly increasing wafer processing efficiencies. It should be appreciated that the present invention can be implemented in numerous ways, including as a process, an apparatus, a system, a device or a method. Several inventive embodiments of the present invention are described below.

In one embodiment, an apparatus for processing a substrate is provided. The apparatus includes a plating head configured to plate a surface of the substrate with a layer of a material using a fluid meniscus between the plating head and a surface of the substrate. The apparatus also includes a fluid meniscus stabilizing apparatus configured to apply a pre-processing fluid to the surface of the substrate before the fluid meniscus is applied to the surface.

In another embodiment, an apparatus for processing a substrate is provided. The apparatus includes a plating head configured to plate a surface of the substrate with a layer of a material using a fluid meniscus located between a surface of the proximity head and a surface of the substrate. A fluid meniscus stabilizing apparatus is included. The fluid meniscus stabilizing apparatus includes at least one input defined in the apparatus configured to receive a fluid meniscus stabilizing fluid. The apparatus further includes an opening defined on a surface of the apparatus configured to apply the fluid meniscus stabilizing fluid to a surface of the substrate. A passage is defined within the apparatus leading from the at least one input to the opening, the passage is configured to transmit the fluid meniscus stabilizing fluid from the at least one input to the opening. The fluid meniscus stabilizing apparatus is configured to apply the fluid meniscus stabilizing fluid to a region of the substrate surface upstream from the fluid meniscus.

In yet another embodiment, a method for stabilizing a fluid meniscus is provided. The method initiates with applying a layer of meniscus stabilizing fluid to a leading region of a surface to be plated. A plating fluid is applied to the leading region with the layer of the fluid meniscus stabilizing fluid and an electric field is applied to a region of the substrate where the plating fluid contacts the surface to be plated.

The advantages of the present invention are numerous. Most notably, the apparatuses and methods described herein stabilize and optimize a fluid meniscus to efficiently process substrates. In one embodiment, operations which utilize optimal management of fluid application to the substrate may be efficiently utilized by using an apparatus that increases uniform distribution of plating fluid on the substrate surface and reduces mechanical resonance. In one embodiment, a stabilized fluid meniscus may be utilized for electroplating operations to generate consistent and efficient plating of substrates.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION

Figure 1A:
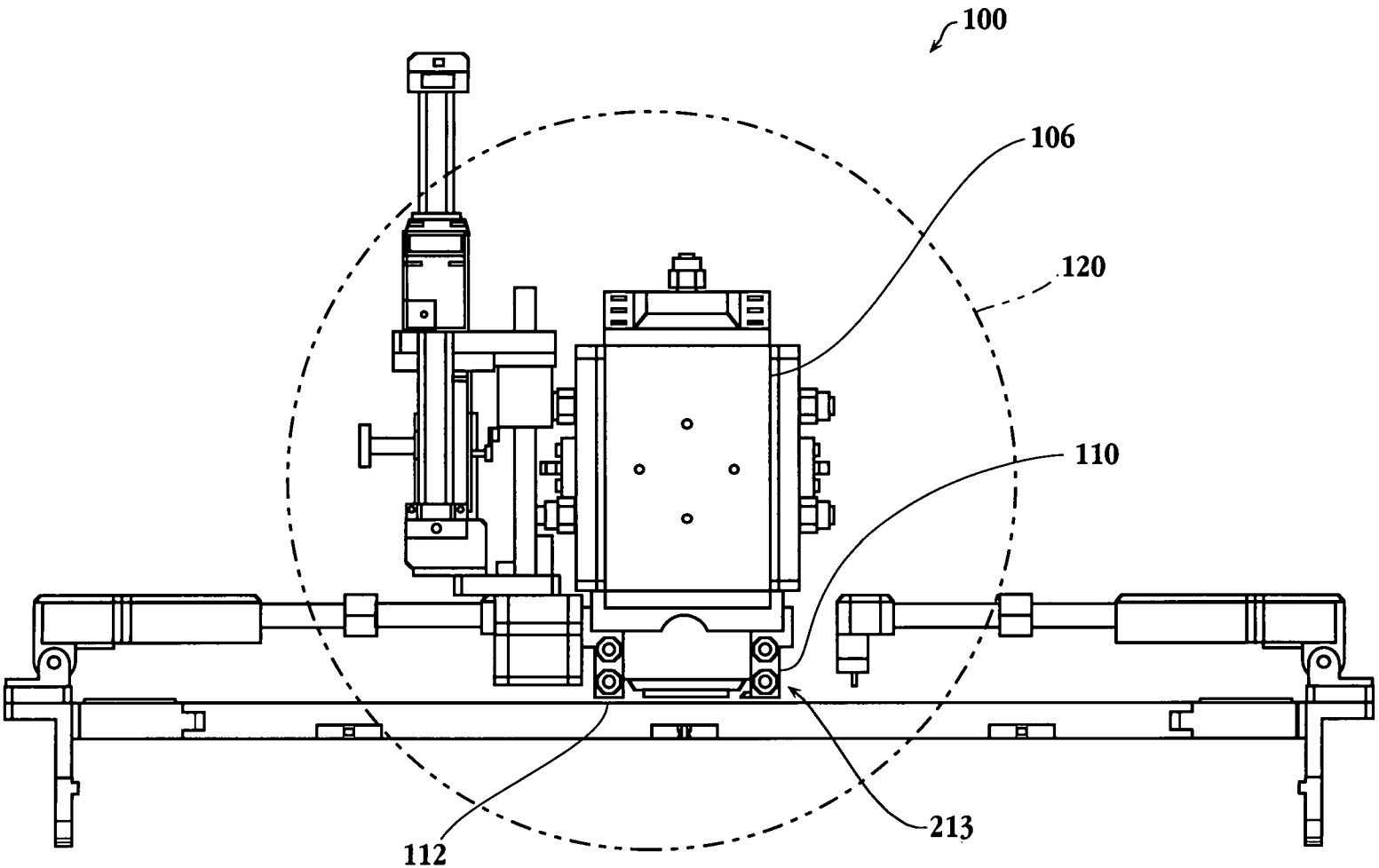
FIG. 1A shows a side view of a substrate plating system in accordance with one embodiment of the present invention.

An invention for methods and apparatuses for processing a substrate is disclosed. In the following description, numerous specific details are set forth in order to provide a thorough understanding of the present invention. It will be understood, however, by one of ordinary skill in the art, that the present invention may be practiced without some or all of these specific details. In other instances, well known process operations have not been described in detail in order not to unnecessarily obscure the present invention.

While this invention has been described in terms of several preferable embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

The figures below illustrate embodiments of an exemplary wafer processing system using plating head(s) with a meniscus stabilizing apparatus to generate a fluid meniscus capable of electroplating a substrate surface. In one embodiment, the plating head may be attached to a meniscus stabilizing apparatus as discussed herein to aid in the uniform distribution of the fluid of the meniscus and reduce mechanical resonance thereby making an exemplary wafer plating operation more consistent. This type of fluid meniscus technology may also be utilized to perform any suitable type of combination of types of wafer operation(s) such as, for example drying, etching, plating, etc.

It should be appreciated that the systems and plating heads as described herein are exemplary in nature, and that any other suitable types of configurations that would enable the generation and movement of fluid menisci described herein may be utilized. It should be appreciated that the substrate and/or the plating may be moved in any suitable motion to apply the fluid meniscus the wafer surface to generate surface plating. In one embodiment, the plating head(s) and/or the wafer may move in a relative linear fashion from one edge of the wafer to another diametrically opposite edge of the wafer thereby processing the wafer. In another embodiment, the substrate may move back under the plating head whereby multiple complete passes of the wafer surface by the plating head can accomplish the wafer processing operation. In other exemplary embodiments, suitable relative non-linear movements of the wafer and/or plating head may be utilized such as, for example, in a radial motion, in a circular motion, in a spiral motion, in a zig-zag motion, in a random motion, etc.

It should be appreciated that other embodiments may be utilized where movement of the plating head(s) and/or the wafer may rotate and/or move one or multiple menisci along the surface of the wafer. In addition, the motion may also be any suitable specified motion profile as desired by a user. In addition, in one embodiment, the wafer may be rotated and the plating head moved in a linear fashion so the plating head may process all portions of the wafer. It should also be understood that other embodiments may be utilized where the wafer is not rotated but the plating head is configured to move over the wafer in a fashion that enables processing of all portions of the wafer. In further embodiments, the plating head may be held stationary and the wafer may be moved to be processed by the fluid meniscus. As with the plating head, the wafer may move in any suitable motion as long as the desired wafer processing operation is accomplished.

In addition, the plating head and the substrate processing system as described herein may be utilized to process any shape and size of substrates such as for example, 200 mm wafers, 300 mm wafers, flat panels, etc. Moreover, the size of the plating head and in turn the size of the meniscus may vary. In one embodiment, the size of the plating head and the size of the meniscus may be larger than a wafer being processed, and in another embodiment, the plating head and the size of the meniscus may be smaller than the wafer being processed. Furthermore, the meniscus as discussed herein may be utilized with other forms of wafer processing technologies such as, for example, brushing, lithography, megasonics, etc.

In one embodiment, the plating head may be a proximity head that is capable of generating a fluid meniscus for electroplating operations. In one embodiment, the plating head may generate a fluid meniscus that can be supported and moved (e.g., onto, off of and across a wafer). Various proximity heads and methods of using the proximity heads are described in co-owned U.S. patent application Ser. No. 10/834,548 filed on Apr. 28, 2004 and entitled "Apparatus and Method for Providing a Confined Liquid for Immersion Lithography," which is a continuation in part of U.S. patent application Ser. No. 10/606,022, filed on Jun. 24, 2003 and entitled "System And Method For Integrating In-Situ Metrology Within A Wafer Process" which is a continuation-in-part of U.S. patent application Ser. No. 10/330,843 filed on Dec. 24, 2002 and entitled "Meniscus, Vacuum, IPA Vapor, Drying Manifold," which is a continuation-in-part of U.S. patent application Ser. No. 10/261,839 filed on Sep. 30, 2002 and entitled "Method and Apparatus for Drying Semiconductor Wafer Surfaces Using a Plurality of Inlets and Outlets Held in Close Proximity to the Wafer Surfaces," both of which are incorporated herein by reference in its entirety. Additional embodiments and uses of the proximity head are also disclosed in U.S. patent application Ser. No. 10/330,897, filed on Dec. 24, 2002, entitled "System for Substrate Processing with Meniscus, Vacuum, IPA vapor, Drying Manifold" and U.S. patent application Ser. No. 10/404,692, filed on Mar. 31, 2003, entitled "Methods and Systems for Processing a Substrate Using a Dynamic Liquid Meniscus." Still additional embodiments of the proximity head are described in U.S. patent application Ser. No. 10/404,270, filed on Mar. 31, 2003, entitled "Vertical Proximity Processor," U.S. patent application Ser. No. 10/603,427, filed on Jun. 24, 2003, and entitled "Methods and Systems for Processing a Bevel Edge of a Substrate Using a Dynamic Liquid Meniscus," U.S. patent application Ser. No. 10/606,022, filed on Jun. 24, 2003, and entitled "System and Method for Integrating In-Situ Metrology within a Wafer Process," U.S. patent application Ser. No. 10/607,611 filed on Jun. 27, 2003 entitled "Apparatus and Method for Depositing and Planarizing Thin Films of Semiconductor Wafers," U.S. patent application Ser. No. 10/611,140 filed on Jun. 30, 2003 entitled "Method and Apparatus for Cleaning a Substrate Using Megasonic Power," U.S. patent application Ser. No. 10/817,398 filed on Apr. 1, 2004 entitled "Controls of Ambient Environment During Wafer Drying Using Proximity Head," U.S. patent application Ser. No. 10/817,355 filed on Apr. 1, 2004 entitled "Substrate Proximity Processing Structures and Methods for Using and Making the Same," U.S. patent application Ser. No. 10/817,620 filed on Apr. 1, 2004 entitled "Substrate Meniscus Interface and Methods for Operation," U.S. patent application Ser. No. 10/817,133 filed on Apr. 1, 2004 entitled "Proximity Meniscus Manifold," U.S. Pat. No. 6,488,040, issued on Dec. 3, 2002, entitled "Capillary Proximity Heads For Single Wafer Cleaning And Drying," U.S. Pat. No. 6,616,772, issued on Sep. 9, 2003, entitled "Methods For Wafer Proximity Cleaning And Drying," and U.S. patent application Ser. No. 10/742,303 entitled "Proximity Brush Unit Apparatus and Method." Additional embodiments and uses of the proximity head are further described in U.S. patent application Ser. No. 10/883,301 entitled "Concentric Proximity Processing Head," and U.S. patent application Ser. No. 10/882,835 entitled "Method and Apparatus for Processing Wafer Surfaces Using Thin, High Velocity Fluid Layer." The aforementioned patent applications are hereby incorporated by reference in their entirety.

It should be appreciated that the system described herein is just exemplary in nature, and the plating heads described herein may be used in any suitable system such as, for example, those described in the United States Patent Applications referenced above.

FIGS. 1A through 9 illustrates stabilization of the fluid meniscus by using a meniscus stabilizing apparatus. The meniscus stabilizing apparatus applies a pre-processing fluid to a substrate surface before the plating head applies a processing fluid meniscus to the substrate surface.

FIG. 1A shows a side view of a substrate plating system 100 in accordance with one embodiment of the present invention. In one embodiment, system 100 includes a plating head 106 configured to generate a fluid meniscus for plating a surface of a substrate. An exemplary configuration of the plating head 106 is described in further detail in reference to FIG. 5. The plating head 106 applies a processing fluid to a surface of a substrate being processed. In one embodiment, a fluid meniscus stabilizing apparatus 110 is attached to the plating head 106 so the apparatus 110 is on a leading side/region 213 of the plating head 106 or over the leading region of the substrate surface. Therefore, in such an embodiment, a portion of a substrate surface to be processed encounters a fluid meniscus stabilizing fluid applied by the apparatus 110 before the fluid meniscus under the plating head 106 is applied to the portion of the substrate surface. As a result, the apparatus 110 can prepare the substrate surface to be processed by the fluid meniscus by applying a layer of the fluid meniscus stabilizing fluid to the substrate surface. A close-up view 120 is discussed in further detail in reference to FIG. 1B. In one embodiment, the system also includes a meniscus generator 112 which applies plating fluid to the substrate surface. In one embodiment, the meniscus generator 112 generates a fluid meniscus between the plating head 106 and the surface to be plated. In such a manner, the substrate surface can be plated in a consistent and time-effective manner. It should be appreciated that the system described herein may be utilized with any suitable manner of generating a fluid meniscus such as, for example, those described in the U.S. Patent Application incorporated by reference above. In addition, the fluid meniscus stabilizing apparatus 110 is described in further detail in reference to FIGS. 2A-9 below.

Figure 1B:
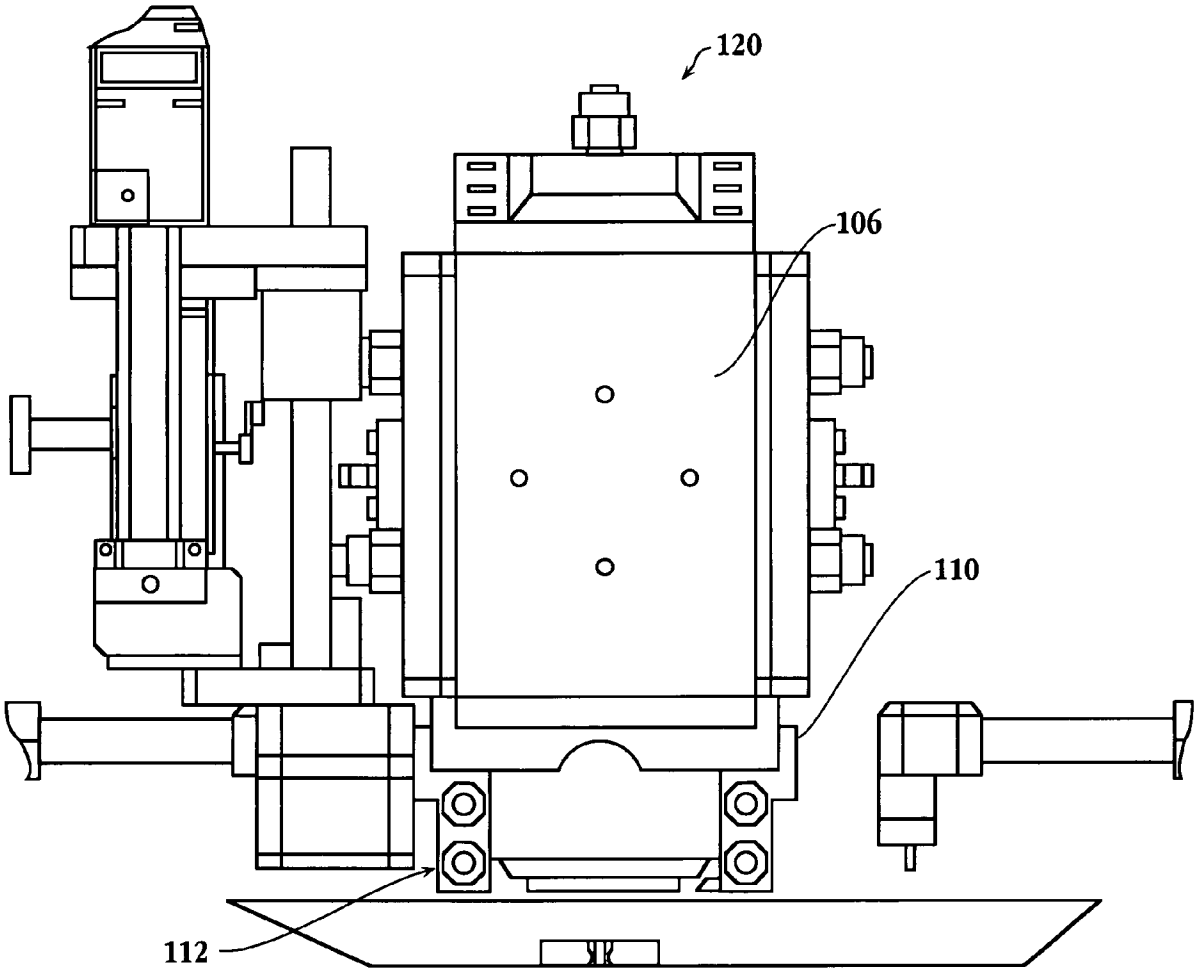
FIG. 1B illustrates the close-up side view of the substrate plating system 100 in accordance with one embodiment of the present invention.

FIG. 1B illustrates the close-up side view 120 of the substrate plating system in accordance with one embodiment of the present invention. As referenced above, the plating head 106 is discussed in further detail in reference to FIG. 5. In one embodiment, the system 100 is configured to hold a substrate to be processed and move the substrate so the plating head 106 scans over the substrate surface. In this way, the plating head with the fluid meniscus generator 112 can create the fluid meniscus on the substrate surface that is capable of electroplating operations. In one embodiment, as the plating head 106 is moved over the substrate surface, the fluid meniscus stabilizer applies a stabilizing fluid to the substrate surface before the fluid meniscus reaches the surface being plated. In this manner, the portion of the substrate to be plated has a layer of stabilizing fluid before the fluid meniscus reaches the portion of the substrate. By having the portion of the substrate pre-processed with stabilizing fluid, the fluid meniscus under the plating head may be made more stable and capable of generating more consistent plating results.

Figure 2A:
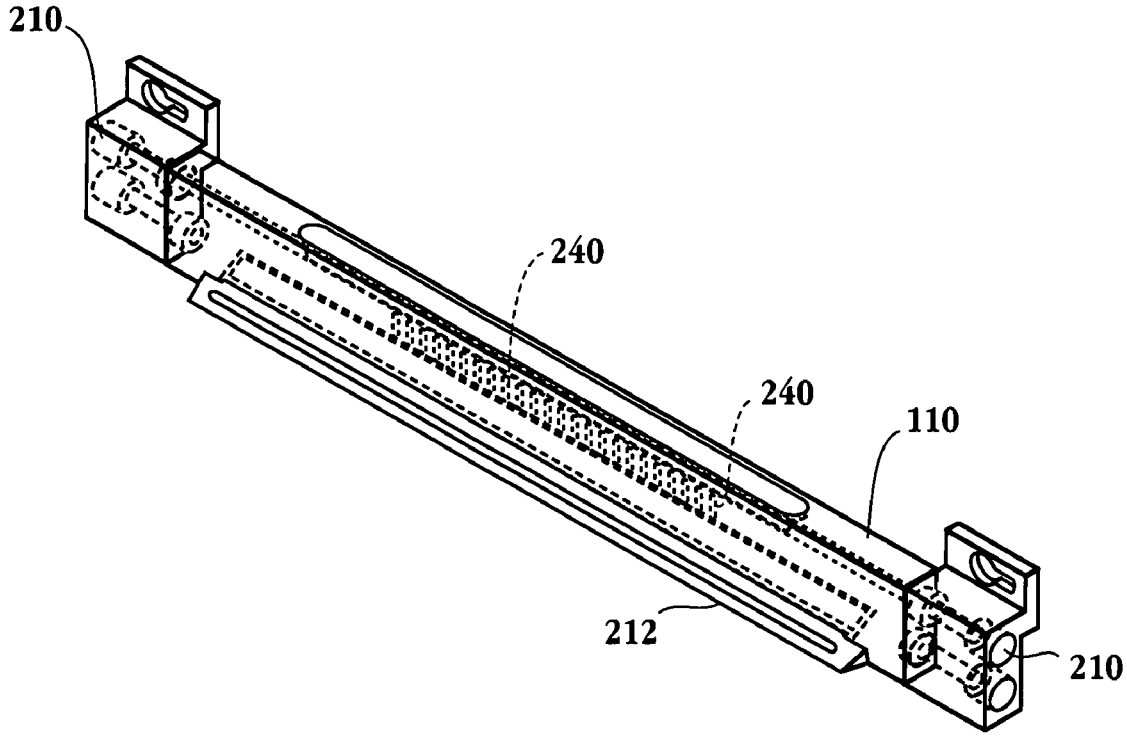
FIG. 2A illustrates an isometric view of the fluid meniscus stabilizing apparatus 110 in accordance with one embodiment of the present invention.

FIG. 2A illustrates an isometric view of the fluid meniscus stabilizing apparatus 110 in accordance with one embodiment of the present invention. In one embodiment, the stabilizing fluid may be inputted into inputs 210. It should be appreciated that the stabilizing fluid may be any suitable fluid that can pre-process the substrate surface so the fluid meniscus under the plating head can be made more stable thereby generating more consistent plating results. In one embodiment, the existence of the stabilizing fluid on the substrate surface can increase uniform distribution of the fluid meniscus and decrease mechanical resonance. In one embodiment, the stabilizing fluid may be 0.85M $CuSO_4$, 60 ppm Cl, 10 g/l $H_2SO_4$, 100 ppm PEG (4000 MW), 20 ppm SPS and DIW.

In one embodiment, the stabilizing fluid may move through internal passages 240 that transports the stabilizing fluid to an applicator 212 which applies the stabilizing fluid to the surface being processed. Exemplary internal passages is described in further detail in reference to FIGS. 3 and 4. In one embodiment, the applicator 212 is an opening or conduit to a region above the substrate surface. The applicator 212 is described in further detail in reference to FIG. 3C.

It should be appreciated that the apparatus 110 may be any suitable dimension that enables the fluid meniscus stabilizing fluid to cover the portion of the substrate that is about to be processed by the fluid meniscus under the plating head 106. In one embodiment the apparatus 110 may be between about 12 inches to 30 inches in length when the plating head is configured to extend at least a diameter of the substrate.

Figure 2B:
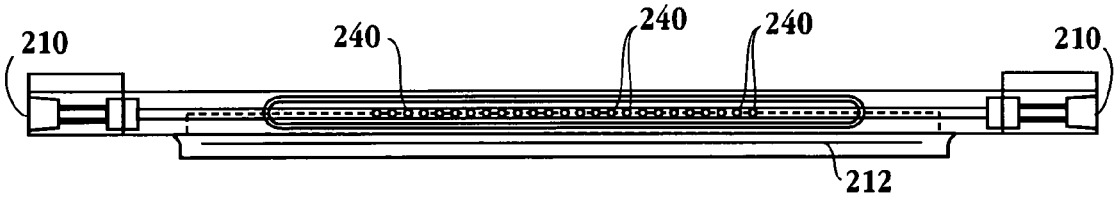
FIG. 2B shows a top view of the fluid meniscus stabilizing apparatus in accordance with one embodiment of the present invention.

FIG. 2B shows a top view of the fluid meniscus stabilizing apparatus 110 in accordance with one embodiment of the present invention. In one embodiment, as discussed in reference to FIG. 2A, the fluid meniscus stabilizing apparatus 110 includes the internal passages 240 that can transport the fluid from the inputs 210 to the applicator 212. An exemplary configuration of the internal passages 240 is discussed in further detail in reference to FIGS. 3C and 4.

Figure 2C:
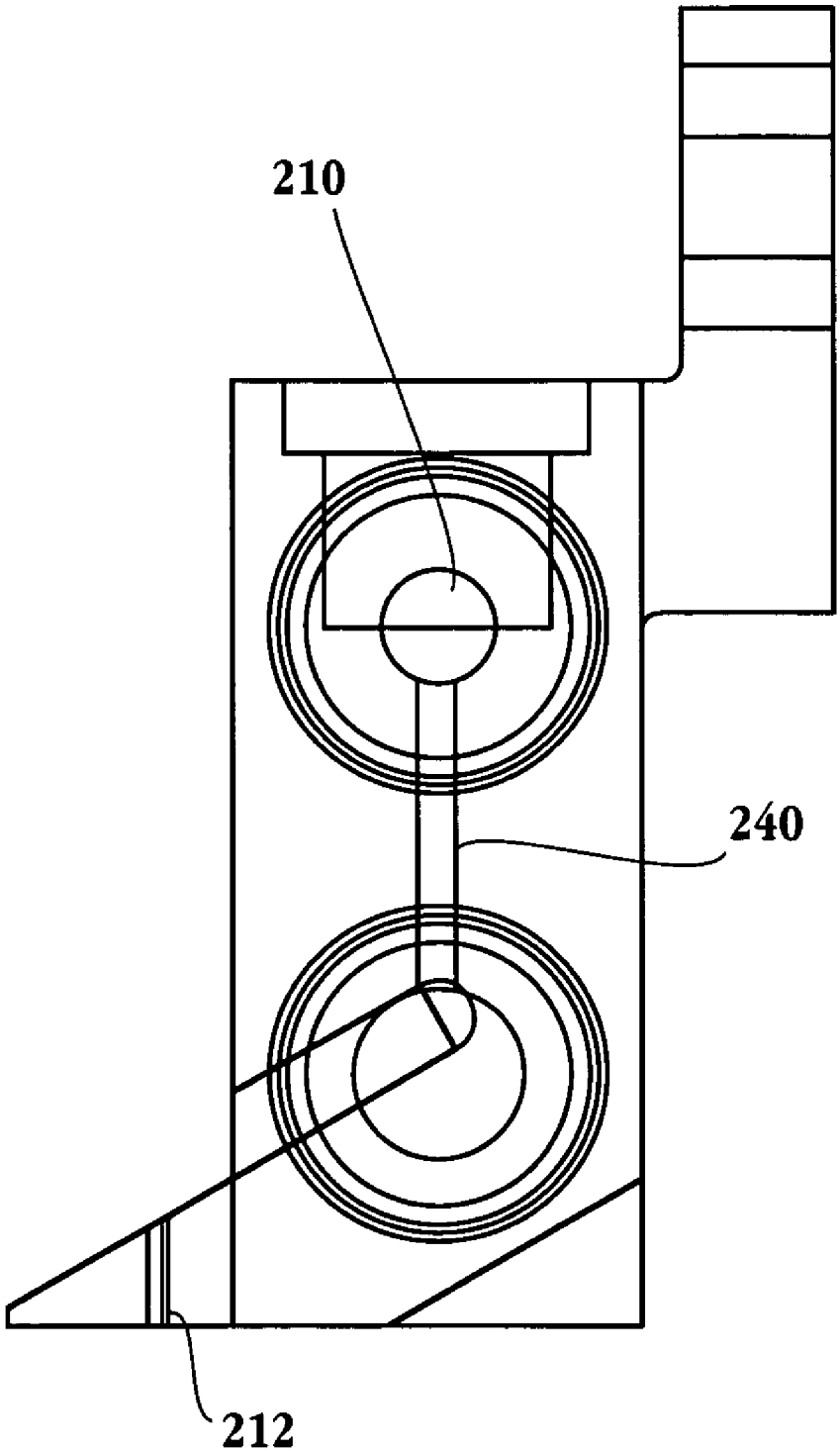
FIG. 2C illustrates a side view of the fluid meniscus stabilizing apparatus in accordance with one embodiment of the present invention.

FIG. 2C illustrates a side view of the fluid meniscus stabilizing apparatus 110 in accordance with one embodiment of the present invention. In one embodiment, the fluid meniscus stabilizing apparatus 110 includes the input 210 and the internal passages 240 which can transport the fluid from the inputs 210 to the applicator 212.

Figure 2D:
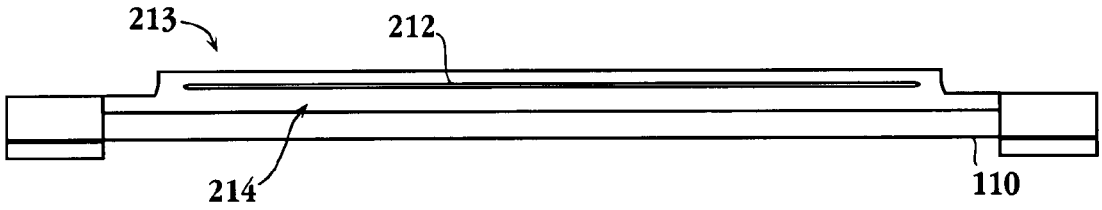
FIG. 2D shows a bottom view of the fluid meniscus stabilizing apparatus in accordance with one embodiment of the present invention.

FIG. 2D shows a bottom view of the fluid meniscus stabilizing apparatus 110 in accordance with one embodiment of the present invention. The fluid meniscus stabilizing apparatus 110 includes a bottom surface 214 which faces the surface to be processed. In addition, in one embodiment, the applicator 212 is on a leading side/region 213 of the apparatus 110 and a fluid layer of stabilizing fluid is applied to the substrate surface. The leading side is the side of the apparatus 110 where pre-processing of the substrate surface by the stabilizing fluid has not occurred.

Figure 2E:
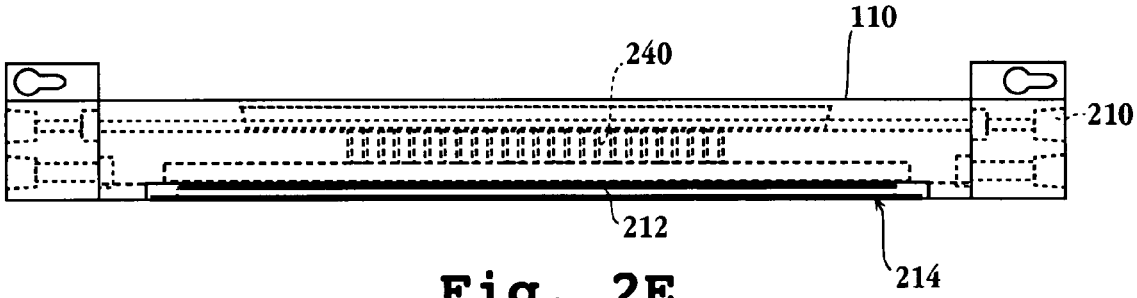
FIG. 2E illustrates front view of the fluid meniscus stabilizing apparatus in accordance with one embodiment of the present invention.

FIG. 2E illustrates front view of the fluid meniscus stabilizing apparatus 110 in accordance with one embodiment of the present invention. In this view, the apparatus 110 is shown in a wire diagram format. The apparatus 110 includes the internal passages 240, the applicator 212, the bottom surface 214 and the input 210.

Figure 3A:
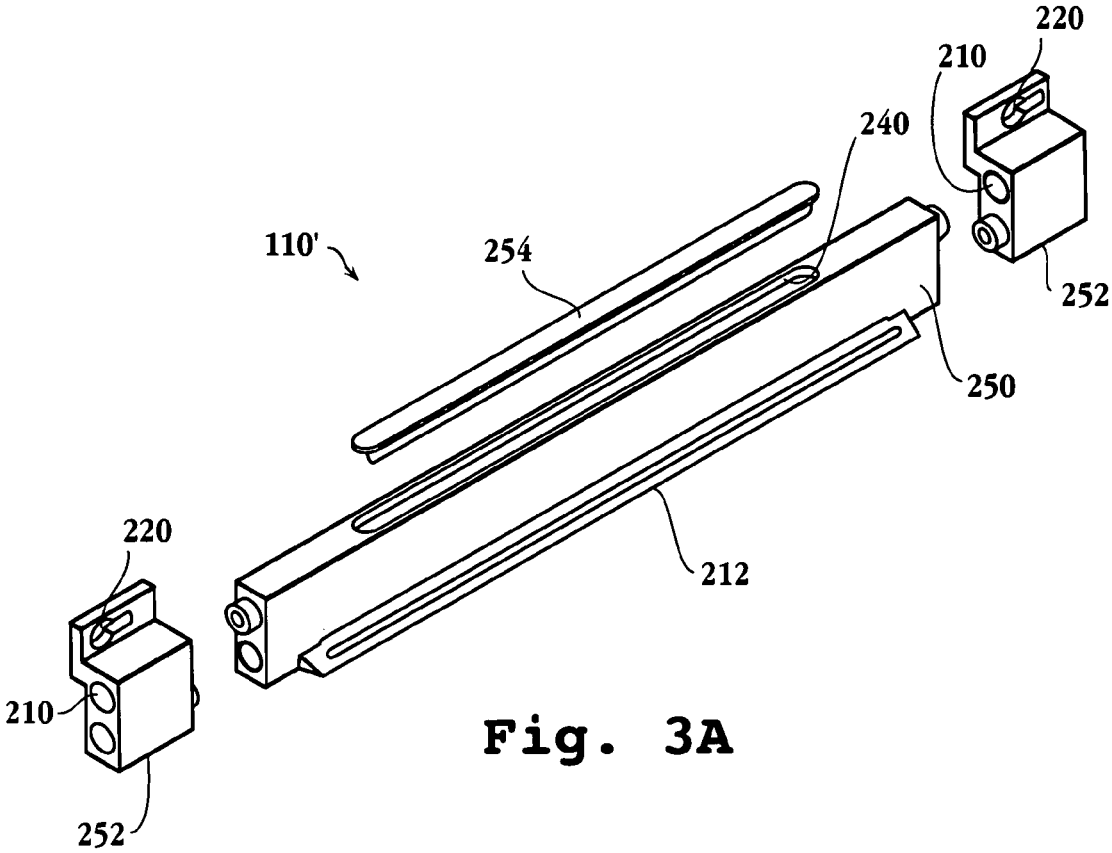
FIG. 3A shows another embodiment of the fluid meniscus stabilizing apparatus in accordance with one embodiment of the present invention.

FIG. 3A shows another embodiment of the fluid meniscus stabilizing apparatus 110' in accordance with one embodiment of the present invention. In one exemplary embodiment, the apparatus 110' includes four parts which may be attached together. In one embodiment, the four parts include a main body 250, end parts 252, and a cover 254 for the internal passages 240. In one embodiment, the main body 250 includes the applicator 212 and the internal passages 240 while the end parts 252 include the inputs 210 through which the stabilizing fluid is inputted. In one embodiment, the fluid meniscus stabilizing apparatus 110' may be bolted to the plating head 106 via holes 220 on the end parts 252.

Figure 3B:
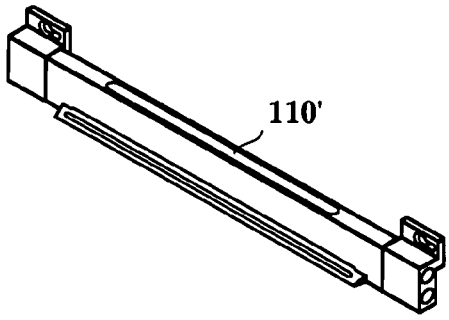
FIG. 3B shows the fluid meniscus stabilizing apparatus with the four parts combined in accordance with one embodiment of the present invention.

FIG. 3B shows the fluid meniscus stabilizing apparatus 110' with the four parts combined in accordance with one embodiment of the present invention.

Figure 3C:
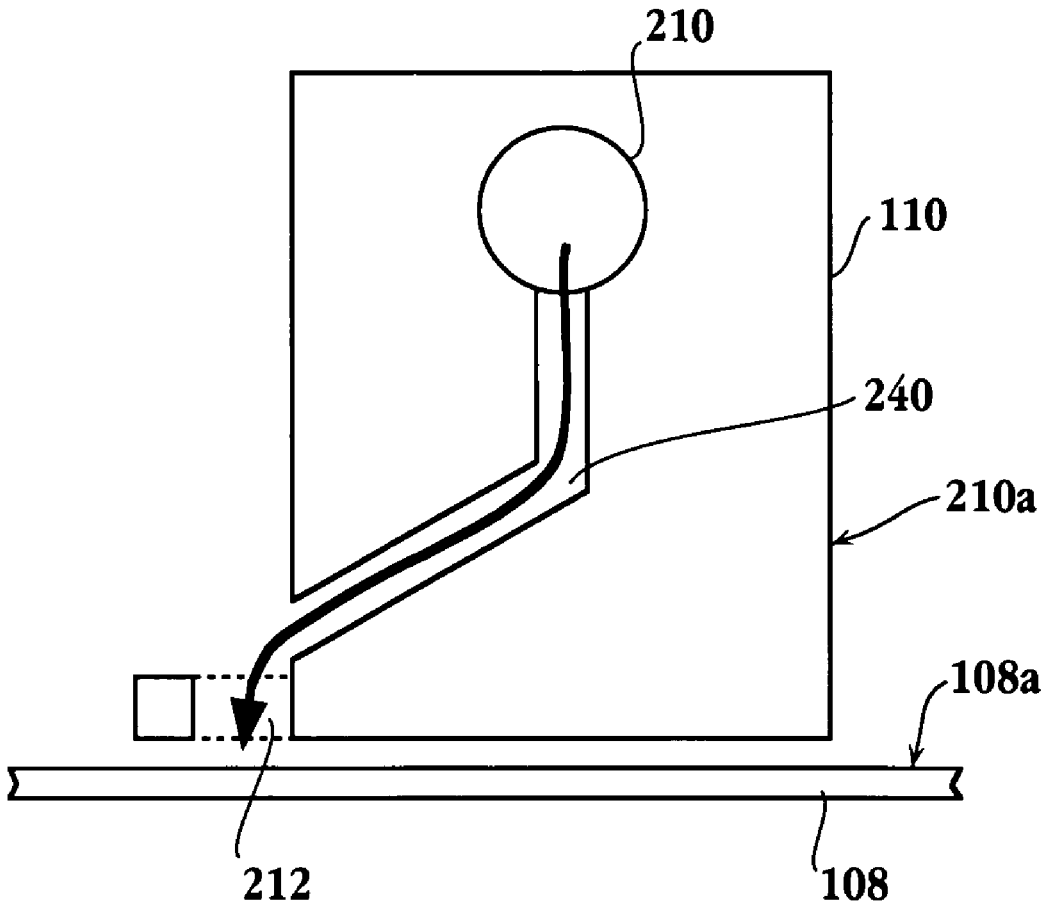
FIG. 3C illustrates a side view of the fluid meniscus stabilizing apparatus in accordance with one embodiment of the present invention.

FIG. 3C illustrates a side view of the fluid meniscus stabilizing apparatus 110' in accordance with one embodiment of the present invention. It should be appreciated that the fluid meniscus stabilizing apparatus 110 may have a similar internal configuration from the side view. The fluid meniscus stabilizing apparatus 110', in one embodiment, may includes the input 210. The fluid utilized to stabilize the fluid meniscus may be applied into the input 210 by any suitable apparatus such as a tube connected to a fluid supply. From the input 210, the stabilizing fluid may be transmitted through the internal passages 240 to an applicator 212 through which the stabilizing fluid can be applied to a surface 108*a* of a substrate 108. It should be appreciated that the applicator 212 may be any suitable opening or conduit that enables the stabilizing fluid to be applied to the surface 108*a* from the internal passages 240. In one embodiment, the fluid meniscus stabilizing apparatus 110' can be connected to the plating head by a bolt and in another embodiment, the fluid meniscus stabilizing apparatus 110' may be made a part of the plating head or yet in another embodiment the fluid meniscus stabilizing apparatus 110' may be attached to the plating head 106 by an adhesive. It should also be appreciated that the apparatus 110 may also be oriented in such a way so the at a side 210*a* may be attached to the plating head 106.

Figure 4A:
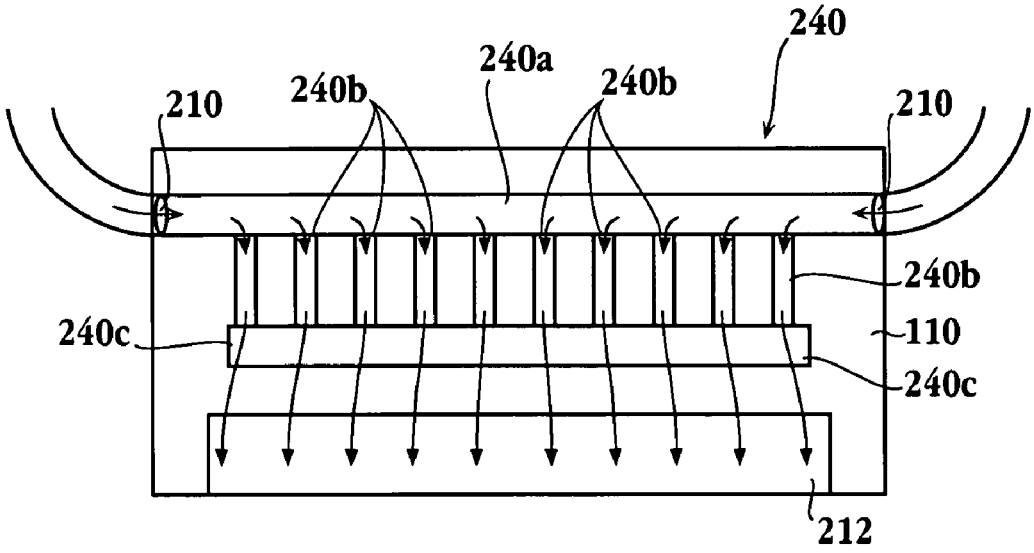
FIG. 4A shows the internal passages within the fluid meniscus stabilizing apparatus in accordance with one embodiment of the present invention.

FIG. 4A shows the internal passages 240 within the fluid meniscus stabilizing apparatus 110 in accordance with one embodiment of the present invention. In one embodiment, the stabilizing fluid is applied into the inputs 210. In one embodiment, the internal passages 240 may include a horizontal passage 240*a*, vertical passages 240*b* and an output 240*c*. The stabilizing fluid after application into the inputs 210 moves through the horizontal passage 240*a*. Then from the horizontal passage 240*a*, the stabilizing fluid moves through the vertical passages 240*b* that transport the stabilizing fluid toward a bottom portion of the fluid meniscus stabilizing apparatus 110'. Then the stabilizing fluid is outputted through the output 240*c*. After the fluid is outputted from the output 240*c*, the stabilizing fluid is applied onto the substrate surface by the applicator 212 of the meniscus stabilizing apparatus 110' so the fluid may be applied between the bottom surface of the apparatus 110' and a substrate surface to be plated.

Figure 4B:
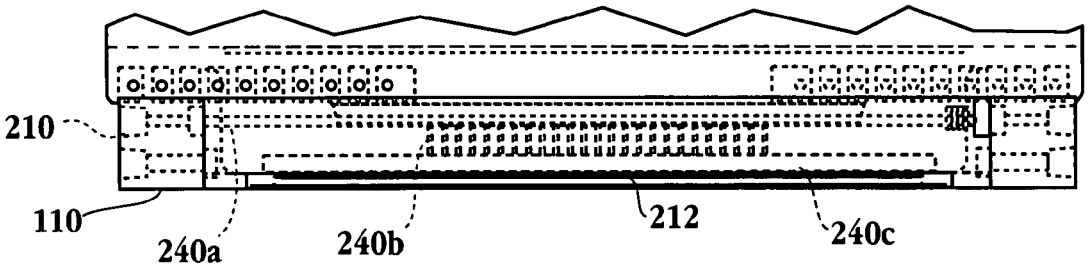
FIG. 4B illustrates a more detailed wire diagram of the fluid meniscus stabilizing apparatus in accordance with on embodiment of the present invention.

FIG. 4B illustrates a more detailed wire diagram of the fluid meniscus stabilizing apparatus 110 in accordance with on embodiment of the present invention. As shown in FIG. 4A, the fluid meniscus stabilizing apparatus 110 includes internal passages 240*a*, 240*b*, and 240*c* through which the fluid meniscus stabilizing fluid can travel from the inputs 210 to the applicator 212.

Figure 5:
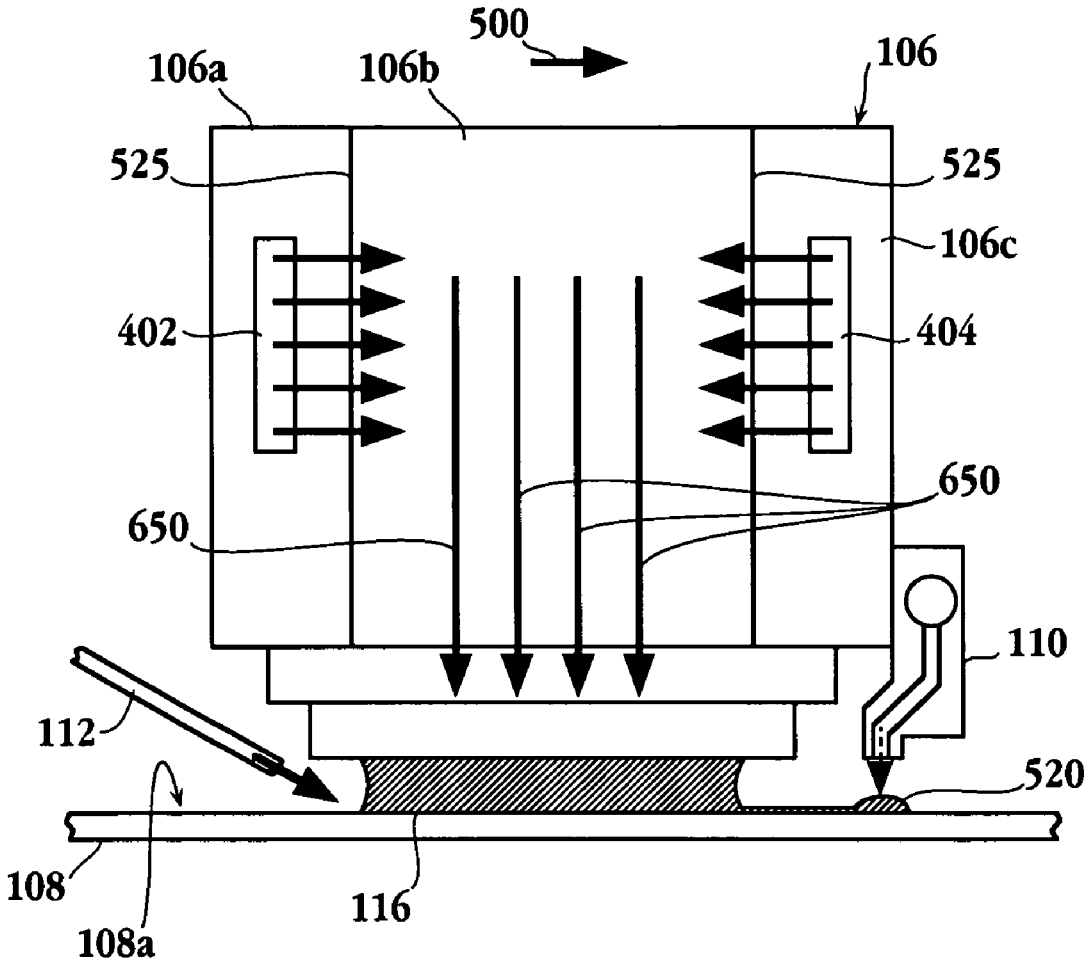
FIG. 5 illustrates the plating head in accordance with one embodiment of the present invention.

FIG. 5 illustrates the plating head 106 in accordance with one embodiment of the present invention. In one embodiment, the plating head 106 includes three compartments 106*a*, 106*b*, and 106*c*. In one embodiment the compartment 106*a* includes electrolyte and an anode-1 402. The compartment 106*b*, in one embodiment, is separated from the compartment 106*a* by a membrane 525 that allows ions of the material comprising the anode-1 through. It should be appreciated that the membrane may be any suitable material such as, for example, hydrophilic ultra high molecular weight polyethylene (UPE), and polytetrafluoroethylene (PTFE) membranes, that can allow desired ions to be passable.

The compartment 106*b* may be a main chamber that also includes electrolyte. In one embodiment, the electrolyte may be any suitable fluid that can have metal ions that can be fluidically transmitted such as, for example, 0.85M $CuSO_4$, 60 ppm Cl, 10 g/1 $H_2SO_4$, 100 ppm PEG (4000 MW), 20 ppm SPS. In one embodiment, the compartment 106*b* and 106*c* may also be separated by the membrane 525 that allows ions of the material making up an anode-2 404 pass through. As shown, the compartment 106*c* includes the anode-2 404 where both the anode-1 402 and the anode-2 404 supplies the ions to enable the plating of the desired substrate surface.

In one embodiment, the plating head 106 is configured to apply an electric field 650 so enable plating of the substrate surface 108*a*. In one embodiment, when copper plating is desired, the anode-1 402 and the anode-2 404 may be copper. The material of the anode-1 402 and the anode-2 404 may be any suitable material that is desired to be plated onto the substrate surface.

The plating head 106 may include the meniscus generator 112 which is configured to apply plating fluid between the plating head 106 and the substrate surface 108*a* to form the fluid meniscus 116. The meniscus generator 112 applies the plating fluid until the fluid meniscus between the plating head 106 and the substrate surface 108*a* is formed. At that point, the meniscus generator 112 stops application of the plating fluid. In one embodiment, the fluid meniscus 116 can include metal ions which can deposit a layer of material when the electric field 650 is applied.

As shown in FIG. 5, in one embodiment, the fluid meniscus stabilizing apparatus 110 can apply a fluid meniscus stabilizing fluid 520 (may also be known as a pre-processing fluid) to the surface 108*a* of the substrate 108. As the substrate is moved in a direction 500, the fluid meniscus stabilizing fluid 520 is applied in a leading side of the plating head 106. In one embodiment, the leading side of the plating head 106 is the side of the plating head 106 which includes substrate surface that is about to be processed. The fluid meniscus stabilizing fluid 520 pre-coats the surface 108*a* of the substrate 108 that is about to be plated by the fluid meniscus 116. By pre-coating the surface 108*a*, the fluid meniscus 116 is stabilized and fluid distribution is increase while decreasing mechanical resonance as the fluid meniscus 116 is moved over the surface 108*a*. In such a configuration, the fluid meniscus 116 keeps encountering the pre-coated surface as it moves in direction 500. Therefore, in one embodiment, the fluid meniscus 116 does not encounter a dry surface as it is moved over the surface 108*a*. This can generate even and consistent plating of the surface 108*a* of the substrate 108.

It should be appreciated that apparatus 110 as described herein may apply any suitable amount of fluid to pre-coat the substrate surface 108*a* as long as the portion of the substrate surface 108*a* that is about to be plated by the plating head 106 is covered with the fluid meniscus stabilizing fluid. In one embodiment, the flow rate of the fluid meniscus stabilizing fluid may be between about 5 ml/min and about ml/min and in a preferable embodiment is about 15 ml/min.

It should also be appreciated that the apparatus 110 as described herein may be a hydrophilic material so the stabilizing fluid is not attracted to the apparatus 110.

The plating head 106 may be any suitable distance away from the substrate surface 108*a* to accomplish the plating operation. In one embodiment, the plating head 106 may be between about 0.2 mm to about 12 mm away from the substrate surface 108*a* with a preferable distance being about 1.5 mm.

In addition, the apparatus 110 as described herein may be any suitable distance away from the substrate surface 108*a* as long as the substrate surface may be pre-coated sufficiently. In one embodiment, the apparatus 110 may be between about 0.2 mm to about 12 mm in distance away from the substrate surface 108*a*. The apparatus 110 as described herein may be attached to the plating head 106 or may be positioned away from the plating head 106 in a leading region. In one embodiment, the apparatus 110 may be between about 0 mm to about 50 mm in front of the plating head 106. In the above description, front is the relative direction in which the plating head 106 is moving in relation to the substrate surface 108*a*. It should be appreciated that although in one embodiment, the relative motion between the plating head 106 and the substrate surface 108*a* is generated by moving the substrate 108, the plating head 106 and/or the substrate 108 may be moved to generate the relative motion.

Figure 6:
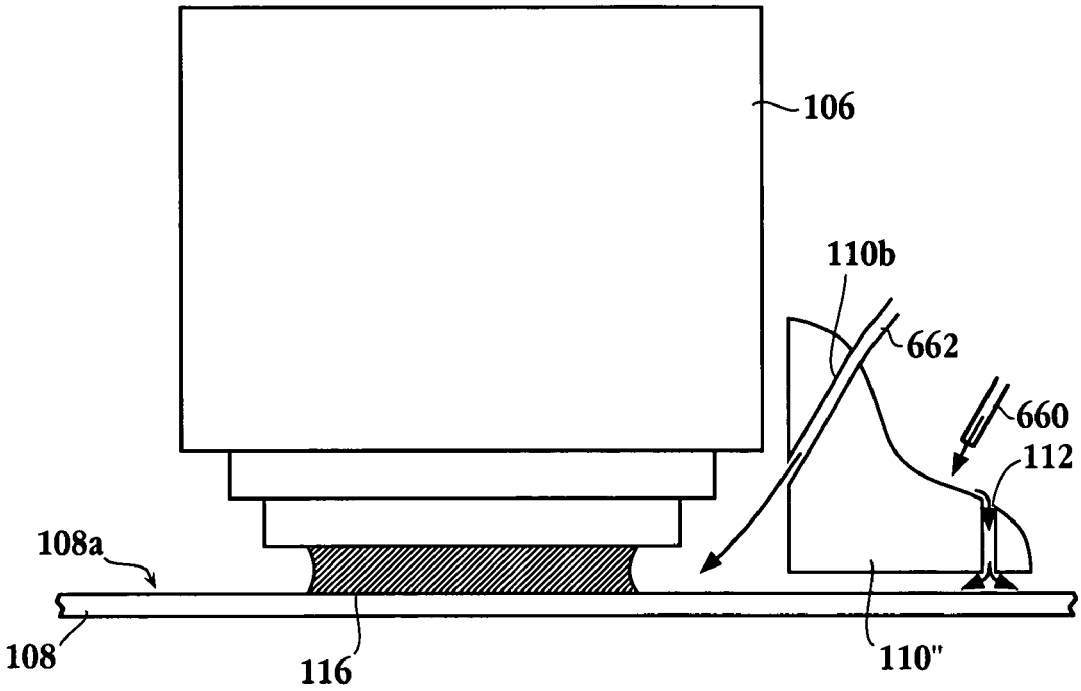
FIG. 6 illustrates a plating head with a fluid meniscus stabilizing apparatus in accordance with one embodiment of the present invention.

FIG. 6 illustrates a plating head 106 with a fluid meniscus stabilizing apparatus 110" in accordance with one embodiment of the present invention. In one embodiment, the plating head 106 may be attached to the fluid meniscus stabilizing apparatus 110" which includes a plating fluid application input 110*b* which can apply plating fluid between the plating head 106 and the substrate surface 108*a*. In this embodiment, instead of using the meniscus generator 112 as shown in FIG. 5, plating fluid application input 110*b* that can be incorporated within the apparatus 110" may be utilized. Therefore, in one embodiment, the plating fluid application input 110*b* can generate the fluid meniscus 116 between the plating head 106 and the substrate surface 108*a*. In one embodiment, the plating fluid may be fed to the fluid meniscus stabilizing apparatus 110" through a tube 662 which can be connected to a fluid supply. In one embodiment, the fluid meniscus stabilizing apparatus 110" also includes the applicator 112 which in one embodiment is a fluid meniscus stabilizing fluid input through which the fluid meniscus stabilizing fluid can be applied to the surface 108*a*.

Figure 7:
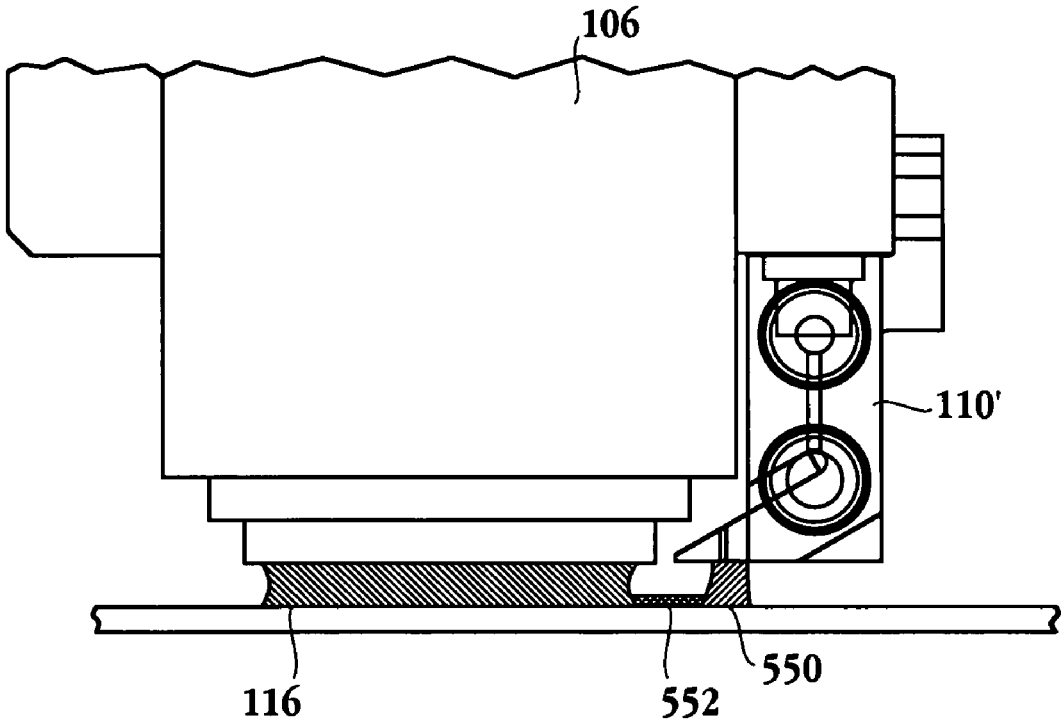
FIG. 7 illustrates the plating head with the fluid meniscus stabilizing apparatus in accordance with one embodiment of the present invention.

FIG. 7 illustrates the plating head 106 with the fluid meniscus stabilizing apparatus 110' in accordance with one embodiment of the present invention. In one embodiment, the fluid meniscus stabilizing apparatus is attached to a leading side of the proximity head 106.

Figure 8:
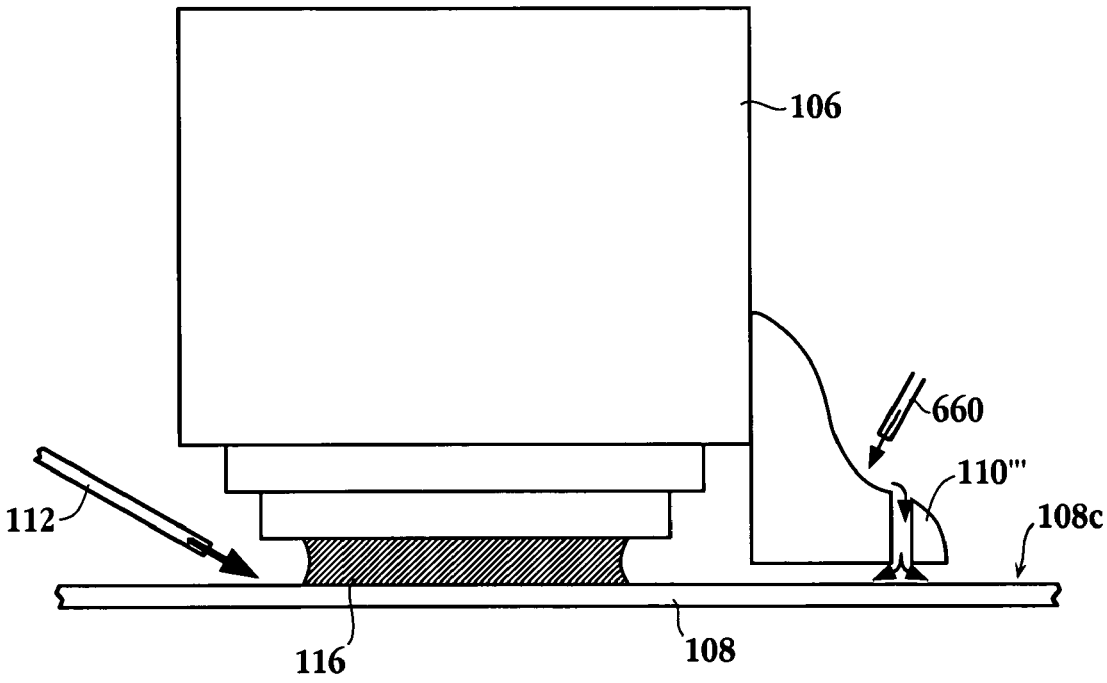
FIG. 8 shows the plating head attached to a fluid meniscus stabilizing apparatus with an external internal plating fluid applicator in accordance with one embodiment of the present invention.

FIG. 8 shows the plating head 106 attached to a fluid meniscus stabilizing apparatus 110'" with an external internal plating fluid applicator in accordance with one embodiment of the present invention. In one embodiment, the fluid meniscus stabilizing apparatus 110'" is configured to be directly attached to the plating head 106. The fluid meniscus stabilizing apparatus 110'" is configured so one side of the apparatus 110'" is substantially flat which can be attached to the plating head 106. The other side of the apparatus 110'" is sloped such that when the input applies a fluid stabilizing fluid to slope, the stabilizing fluid flows down the slope into an opening/slit through the apparatus 110". The opening/slit may be one end of a conduit that extends through a top portion of the apparatus 110'" to a bottom portion of the apparatus 110' with an opening/slit that is configured to be proximate to a substrate surface in operation. In this fashion when the stabilizing fluid enters the opening, the fluid is moved through the apparatus 110'" an applied to the substrate surface.

Figure 9:
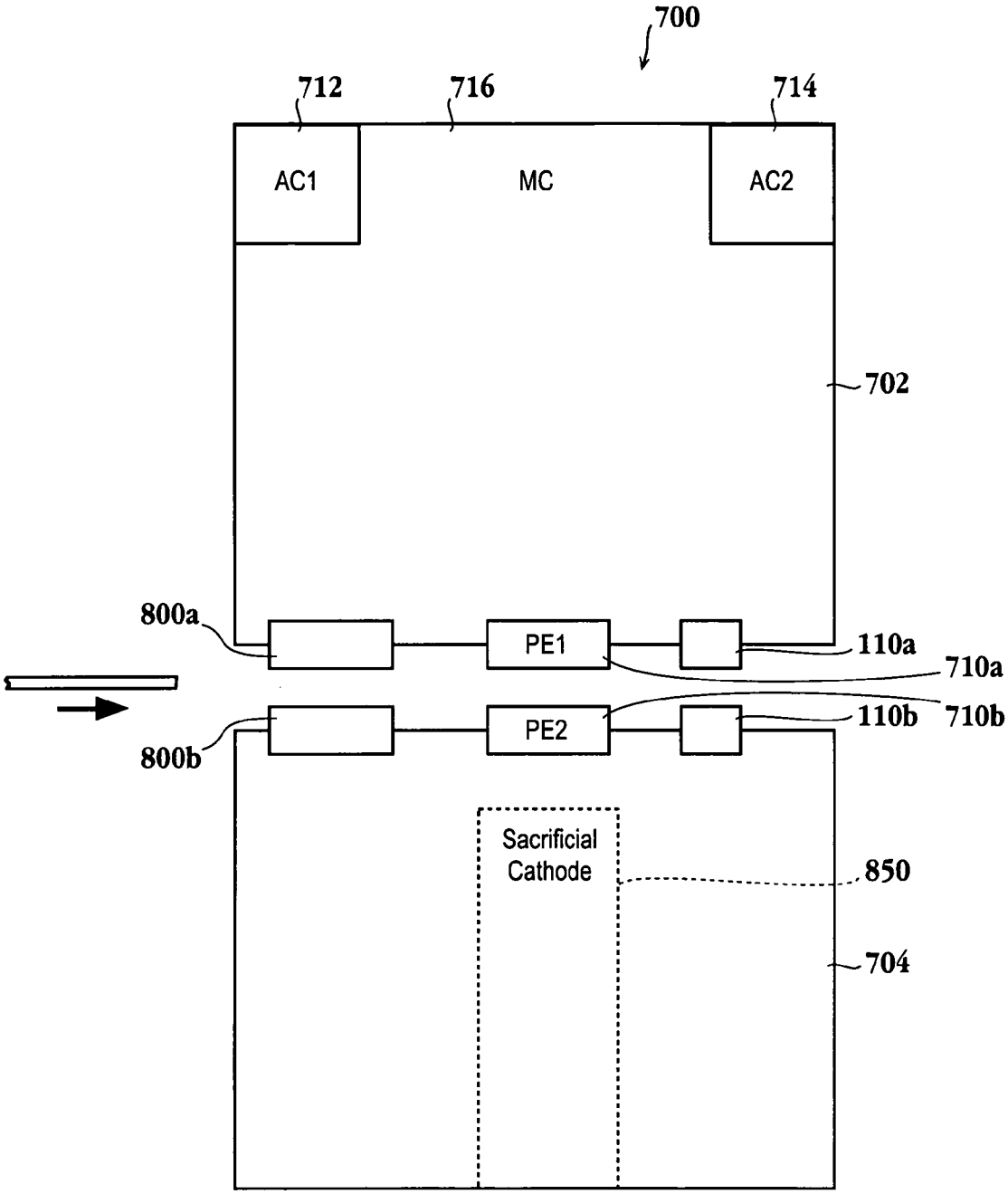
FIG. 9 illustrates a substrate plating system in accordance with one embodiment of the present invention.

FIG. 9 illustrates a substrate plating system 700 in accordance with one embodiment of the present invention. In one embodiment, the plating system 700 includes a top surface plating apparatus 702 and a bottom surface plating apparatus 704. In one embodiment, the top surface plating apparatuses 702 and 704 may be configured like the plating head 106 described in further detail above. The top surface plating apparatus 702 may include a plating element-1 710*a*, an anode compartment-1 712*a* and an anode compartment-2 714*a* with an electrolyte compartment 716*a* in between. The top surface plating apparatus 702 can further include the fluid meniscus stabilizing apparatus 110*a* and a rinsing apparatus 800*a*. In one embodiment the rinsing apparatus 800*a* may be a proximity head capable of generating a fluid meniscus described in the patent applications incorporated by reference above.

The bottom surface plating apparatus 704 includes a plating element-2 710*b*, a fluid meniscus stabilizing apparatus 110*b*, a rinsing apparatus 800*b*, and optionally a sacrificial cathode 850. The plating element-2 710*b* and the fluid meniscus stabilizing apparatus 110*b* may be configured as described herein. In addition, the rinsing apparatus 800*b* may be a proximity head that is capable of generating a rinsing fluid meniscus. In one embodiment, the bottom surface plating apparatus 704 can be an enantiomer (i.e. a mirror image) of the top surface plating apparatus 706.

In another embodiment, as shown in FIG. 9, a sacrificial cathode 850 may be utilized instead of attaching electrodes to the substrate itself. In this way, the sacrificial cathode of the bottom surface plating apparatus 704 and the anode of the top surface plating apparatus can form a circuit. By using the top surface plating apparatus 704 and the bottom surface plating apparatus 706, both the top surface and the bottom surface of the substrate may be plated. In one embodiment, the fluid meniscus stabilizing apparatuses may be positioned in a leading side of the top surface plating apparatus and the bottom surface plating apparatus. The rinsing apparatuses of the top surface plating apparatus and the bottom surface plating apparatuses may be positioned so the portions of the substrate that has been plated can be rinsed to remove any contaminants, extra electrolytes, or particles from the surfaces of the substrate.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. An apparatus for processing a substrate, comprising:

a plating head configured to plate a top surface of the substrate with a layer of a material using a fluid meniscus between the plating head and a surface of the substrate, the plating head disposed above a top surface of the substrate, wherein the fluid meniscus is delivered and removed through the plating head; and a fluid meniscus stabilizing apparatus affixed to a side surface defined around a periphery of the plating head and disposed above the top surface of the substrate, the fluid meniscus stabilizing apparatus configured to apply a pre-processing fluid to the surface of the substrate before the fluid meniscus is applied to the surface, the fluid meniscus stabilizing apparatus having a sloped top surface sloping downward from the periphery leading to an opening extending through the fluid meniscus stabilizing apparatus to the top surface of the substrate wherein the pre-processing fluid is delivered to the sloped surface through an applicator and flows to the top surface of the substrate through the opening.

2. An apparatus for processing a substrate as recited in claim 1, wherein the pre-processing fluid pre-coats a portion of the surface of the substrate to be plated by the fluid meniscus.

3. An apparatus for processing a substrate as recited in claim 1, wherein the fluid meniscus stabilizing apparatus includes a second opening for delivering fluid for the fluid meniscus to a leading edge of the-plating head.

4. An apparatus for processing a substrate as recited in claim 3, wherein a plating element is disposed under a bottom surface of the substrate.

5. An apparatus for processing a substrate as recited in claim 4, wherein the plating element includes a cathode.

6. An apparatus for processing a substrate as recited in claim 5, wherein the plating head includes an anode.

7. A method for electroplating a substrate, comprising:

applying a layer of meniscus stabilizing fluid to a leading region of a surface of a substrate to be plated through a fluid meniscus stabilizing apparatus of a plating head disposed above a top surface of the substrate, the fluid meniscus stabilizing apparatus affixed to a side surface defined around a periphery of the plating head, the meniscus stabilizing fluid applied to a top sloped surface of the fluid meniscus stabilizing apparatus affixed to the plating head, wherein the top sloped surface slopes downward from the periphery and includes an opening enabling access to the surface of the substrate;

applying a plating fluid to the leading region with the layer of the fluid meniscus stabilizing fluid through the fluid meniscus stabilizing apparatus, the meniscus formed through the simultaneous removal and delivery of the plating fluid through the plating head; and applying an electric field to a region of the substrate where the plating fluid contacts the surface to be plated.

8. A method for stabilizing a fluid meniscus as recited in claim 7, wherein applying the electric field includes attaching electrodes to the substrate.

9. A method for stabilizing a fluid meniscus as recited in claim 8, wherein the fluid meniscus stabilizing fluid is dispensed through an applicator onto the sloped surface.

10. A method for stabilizing a fluid meniscus as recited in claim 7, wherein applying the electric field includes forming an electroplating circuit through placement of a cathode below the surface of the substrate and an anode above the surface of the substrate.

11. A method for stabilizing a fluid meniscus as recited in claim 7, wherein the plating fluid is an electrolyte with ions of a material to be deposited on the substrate surface.

12. A method for stabilizing a fluid meniscus as recited in claim 7, wherein the fluid meniscus stabilizing fluid is one of, Chlorine, $H_2SO_4$, PEG, SPS.

13. A method for stabilizing a fluid meniscus as recited in claim 7, wherein the leading region is a region of the substrate which is approaching the plating head during a plating operation.

14. A method for stabilizing a fluid meniscus as recited in claim 7, wherein the fluid meniscus encounters a layer of the fluid meniscus stabilizing fluid on a region of the substrate to be plated during a plating operation.

15. A method for stabilizing a fluid meniscus as recited in claim 7, wherein application of the fluid meniscus stabilizing fluid on a region of the substrate to be plated during a plating operation generates consistent substrate plating.

16. An apparatus for processing a substrate, comprising:

a plating head configured to plate a surface of the substrate with a layer of a material using a fluid meniscus located between a surface of a proximity head and a surface of the substrate, the plating head disposed above a top surface of the substrate, wherein the fluid meniscus is removed through the plating head; and a fluid meniscus stabilizing apparatus affixed around a periphery of the plating head, the fluid meniscus stabilizing apparatus, including, at least one input defined in the apparatus configured to receive a fluid meniscus stabilizing fluid; and an opening defined on a sloped surface of the fluid meniscus stabilizing apparatus configured to enable access of the fluid meniscus stabilizing fluid to a surface of the substrate, the sloped surface extending downward from the periphery, wherein the fluid meniscus stabilizing fluid is delivered to a region of the substrate surface upstream from the fluid meniscus.

17. An apparatus for processing a substrate as recited in claim 16, wherein the fluid meniscus stabilizing fluid pre-coats a portion of the surface of the substrate to be plated by the fluid meniscus and wherein the fluid meniscus is delivered through an opening extending through the fluid meniscus stabilizing apparatus.

18. An apparatus for processing a substrate as recited in claim 16, wherein the fluid meniscus stabilizing apparatus includes an applicator for applying the fluid meniscus stabilizing fluid to the surface of the substrate.

19. An apparatus for processing a substrate as recited in claim 16, wherein the pre-processing fluid is one of Chlorine, $H_2SO_4$, PEG, SPS.

20. The apparatus of claim 1, wherein the pre-processing fluid is one of, Chlorine, $H_2SO_4$, PEG, SPS.

* * * * *